US007104181B2

(12) United States Patent
Bitter et al.

(10) Patent No.: US 7,104,181 B2
(45) Date of Patent: Sep. 12, 2006

(54) HYDRAULIC CONTROL CIRCUIT FOR A HYDRAULIC LIFTING CYLINDER

(75) Inventors: Marcus Bitter, Contwig (DE); David Price, Staffordshire (GB); Steffen Schlemmer, Althombach (DE); Marlin Onnen, Cedar Falls, IA (US)

(73) Assignee: Deere & Company, Moline, IL (US)

( * ) Notice: Subject to any disclaimer, the term of this patent is extended or adjusted under 35 U.S.C. 154(b) by 140 days.

(21) Appl. No.: 10/782,152

(22) Filed: Feb. 18, 2004

(65) Prior Publication Data

US 2004/0221714 A1 Nov. 11, 2004

(30) Foreign Application Priority Data

Feb. 21, 2003 (DE) ..... 103 07 346

(51) Int. Cl.
*F15B 11/044* (2006.01)

(52) U.S. Cl. ..... 91/437; 91/451

(58) Field of Classification Search ..... 91/437, 91/450, 451

See application file for complete search history.

(56) References Cited

U.S. PATENT DOCUMENTS

| | | | | |
|---|---|---|---|---|
| 3,472,127 | A * | 10/1969 | Scheidt | 91/437 |
| 4,024,796 | A * | 5/1977 | Theobald | 91/451 |
| 5,415,076 | A | 5/1995 | Krone et al. | |
| 6,405,633 | B1 * | 6/2002 | Dueckinghaus et al. | 91/451 |

FOREIGN PATENT DOCUMENTS

| | | |
|---|---|---|
| DD | 205 471 | 12/1983 |
| DE | 32 16 580 | 5/1982 |
| DE | 38 40 246 | 11/1988 |
| DE | 41 29 509 | 9/1991 |
| DE | 199 32 948 | 7/1999 |
| DE | 100 06 908 A1 | 8/2001 |
| DE | 101 49 787 A1 | 5/2002 |

OTHER PUBLICATIONS

Hydac International "Flutex 2-Wege-Stromregelventile".
Hydac International "Flutec Rohrbruchsicherungen RBE".
Patent Abstracts of Japan vol. 1998, No. 04, Mar. 31, 1998 & JP 09 317706 A, Dec. 9, 1997.
Patent Abstracts of Japan vol. 1998, No. 11, Sep. 30, 1998 * JP 10 168949 A, Jun. 23, 1998.

* cited by examiner

*Primary Examiner*—F. Daniel Lopez

(57) ABSTRACT

A hydraulic control circuit for a hydraulic cylinder is described for the raising and lowering of a boom on a telescopic loader. First and second chambers of the hydraulic cylinder are connected to a control valve over first and second supply lines and are selectively connected to either a hydraulic pressure source or to a hydraulic reservoir. The circuit includes on-off valves for controlling the flow through a first hydraulic line extending between the first chamber of the cylinder and the hydraulic reservoir, and through a second hydraulic line extending between the second chamber and the hydraulic reservoir in such a way that a floating position can be provided. Furthermore, a load-holding valve arrangement is provided in the first supply line at a location between the control valve and the first chamber of the cylinder. To provide assurance against uncontrolled lowering of the boom during switching to the floating position under load, a valve arrangement is provided that controls the flow rate as a function of the flow rate.

4 Claims, 3 Drawing Sheets

HYDRAULIC CONTROL CIRCUIT FOR A HYDRAULIC LIFTING CYLINDER

FIELD OF THE INVENTION

The invention concerns a hydraulic control circuit for a hydraulic cylinder with a control valve that selectively connects at least a first chamber of the hydraulic cylinder over a first supply line with a hydraulic pressure source or a hydraulic reservoir. Furthermore the valve arrangement includes a first on-off valve that controls the flow through the first hydraulic line extending between the first chamber and the hydraulic reservoir, and which opens on the basis of a switch signal, whereby a floating position can be provided.

BACKGROUND OF THE INVENTION

Hydraulic float control systems, in which floating positions have been implemented that permit a free movement of a hydraulic consumer, are known in the state of the art. Here, both connecting sides of the hydraulic consumer are connected to each other as well as at low pressure or without pressure to a hydraulic container or reservoir. Float control systems of this type are applied to construction or loader vehicles in which a boom or loader arm can be raised or lowered by means of a lifting cylinder. The function of the floating position is required, for example, to make it possible for a tool attached to the boom or loader arm to follow the contour of the ground closely independently of the position or orientation of the vehicle. Thereby, the tool is forced against the ground solely by the force of gravity. Such control systems do not contain any load-holding valves that prevent or sharply slow an unintended lowering of the boom or loader arm for reasons of safety when a leakage is encountered in the connection between the cylinder and control valve. Since a control pressure is required for the opening or circumventing of the load holding valve, a solution of the combination of a load-holding valve with a floating position is not known, in this case a non-pressurized condition of the hydraulic consumer is present and hence no control pressure can be used.

DE 101 49 787 A1 discloses a control system including a floating condition to control a double-acting consumer in which a control valve is loaded with pressure in a through-flow position and a floating position can be attained by a pressure controlled valve arrangement. Throttling is brought about over the control edges of the control valve where changes in the velocity of the consumer upon the transition into the floating position should effectively be avoided. Here the disadvantage is that the throttling is performed over a control arrangement supplied by a pump that is costly in its configuration as a control valve and results in a high degree of control inertia and at high loads unintended and uncontrolled pivoting movements result upon shifting to a floating position despite the throttling. Furthermore, the control system does not contain a load-holding valve to secure the hydraulic operation of the consumer.

DE 100 06 908 A1 discloses a hydraulic piston-cylinder unit for agricultural utility machines with a load-holding valve, in which an operating position is reached in which a constant pressure can be adjusted in the piston side chamber of the cylinder. Thereby a boom or a tool attached to it can be brought into contact with the ground constantly with a pre-determined contact force. This operating position is reached in that the pressure chambers of the piston-cylinder unit are connected to each other and pressure equalization occurs between the two pressure chambers over a pressure control valve. If the pressure drops below a pre-determined value, the pressure control valve closes. Here a floating position is possible only if the pre-determined value is set to zero, so that no pressure control is performed. The disadvantage then is that upon switching under load, the boom or the tool would be lowered uncontrolled.

DD 205 471 discloses a hydraulic circuit arrangement in which a floating position can be established upon the desire of an operator in which the chambers of a cylinder are connected with a container or sump by means of a three-position, two-way valve. A throttled outflow is guaranteed on the pressure side of the cylinder over a one-way restrictor in the operating position as well as in the floating position. The disadvantage is that upon switching into the floating position under load, the constant cross section of the throttle, designed for the operation, cannot control the lowering of the pressure side. Furthermore such a one-way restrictor does not represent a load-holding valve, which could prevent an uncontrolled lowering of the load in its operating position.

SUMMARY OF THE INVENTION

The task underlying the invention is seen as that of defining a hydraulic circuit arrangement or control system of the aforementioned type through which the above noted problems are overcome. In particular a control circuit is proposed wherein a floating position can be attained, and upon switching from the operating position into the floating position, a controlled lowering or retention of the pressure side can be performed. A further object of the task is to provide a hydraulic control circuit wherein, in addition to the floating position, there is provided a load-holding valve for an operating condition.

According to the invention, a control system or circuit of the type noted initially is equipped with a valve arrangement that controls the flow rate as a function of the flow in the first hydraulic line. A valve arrangement that controls as a function of the flow rate has the advantage that the flow rate can be controlled independently of the pressure in the hydraulic line so that only a certain flow amount reaches through the hydraulic line with a low as well as a high hydraulic load and thereby a safety function is offered. If, for example, while the first chamber of the hydraulic cylinder is loaded with pressure, the valve arrangement is brought into the floating position in which the on-off valve is switched into a through-flow position by a switching signal, then the valve arrangement controlling as a function of the flow rate provides the assurance that the flow rate can change only within certain limits or does not exceed a certain value independently of the magnitude of the pressure.

In a preferred embodiment of the invention, the control circuit or system includes a set-up agent that changes the flow opening, for example, a slide or closing elements that is exposed, on the one hand, to the pressure in the first chamber, and on the other hand, to the pressure in the reservoir, as well as a spring force. The through-flow opening of the set-up agent changes or closes as a function of the pressure difference between the two through-flow sides, that adjusts itself on the basis of a predominant flow rate.

In a particularly preferred embodiment of the invention, the control circuit includes means that reduce or increase the through-flow cross section respectively with an increasing or falling pressure gradient across a control valve arrangement. This has the advantage, that if on the basis of an increasing pressure in the hydraulic line the flow rate increases, the pressure gradient between the through-flow inlet and through-flow outlet increases. Simultaneously, the through-flow cross section across the control valve arrangement is then reduced, so that the pressure gradient is again reduced. As a result of the decreasing pressure gradient, the through-flow cross section of the control valve arrangement, in turn is reduced, so that a controlling or regulating condition is attained, so that the flow rate is largely held constant or within certain limits in the presence of a pressure gradient.

In a particularly preferred embodiment of the invention, the hydraulic control system contains a flow control valve that changes the flow rate as a function of the flow and limits it to a maximum value. Flow control valves of this type are offered, for example, by the "HYDAC International" company. An exact description can be obtained from DIN-ISO 1219. A flow control valve includes a pressure difference controller that controls or regulates the through-flow as a function of the flow with a control piston, a compression spring, a control orifice, and an adjusting screw for setting the control pressure difference. With increasing flow rate or increasing through-flow, that is, increasing pressure gradient, the cross section of the control orifice is reduced corresponding to the increased pressure gradient until a force balance is again established. The continuous re-controlling of the pressure difference control, according to the immediately existing pressure gradient, results in a constant flow rate being attained in one control direction, where the control direction preferably corresponds to the direction of flow of the hydraulic fluid out of the chamber of the hydraulic cylinder loaded with high pressure, preferably the lifting side of the hydraulic cylinder, in the direction towards the reservoir. In the opposite direction, the flow through the valve may be uncontrolled. Such a valve has the advantage that even at extremely high pressure loads, a flow rate results at all times in a pressure difference where the control pressure difference can be provided as input over the adjusting screw. As a result, upon the shift from the operating position to the floating position under load, a controlled pressure reduction is attained largely independent of the amount of the existing pressure and thereby a safety feature is available upon the shift into the floating position.

In a particularly preferred embodiment of the invention, the hydraulic control circuit or system includes a check valve arranged in parallel with the flow control valve that opens in the direction towards the first chamber. This provides the assurance that the hydraulic fluid flowing in the direction towards the reservoir is forced to flow through the flow control valve and correspondingly flows out of the chamber loaded with high pressure under control, where on the other hand, a flow in the opposite direction can take place without any hindrance.

In another preferred embodiment of the invention, the valve arrangement contains means that reduces or interrupts the flow rate when a predetermined pressure gradient is exceeded. This provides assurance that, when a flow rate is reached that brings about the predetermined pressure gradient, the connection is interrupted so that the pressure is maintained in the first chamber which was loaded with high pressure or in the first hydraulic line. If the pressure again drops off, the connection is re-established as soon as the predetermined pressure gradient is reached or a flow rate is established which brings about a pressure gradient that is smaller than or equal to the predetermined pressure gradient.

In a preferred embodiment of the invention, the valve arrangement contains a pipe break safety valve which closes when a predetermined pressure gradient is reached or exceeded and opens when the predetermined pressure gradient is not reached. Such pipe break safety valves are offered, for example, by "HYDAC International" and are described in greater detail in the catalog of the company "HYDAC INTERNATIONAL-FLUTEC Rohrbruck Sicherungen RBE" (Pipe Break Security Devices) "Flutec"—pipe break security devices are flat-seat valves that are controlled as a function of the flow rate that prevent impermissible and uncontrolled movements of a consumer under an applied load. A pipe brake safety valve contains a closing element, for example, a closing piston in the form of a plate valve that is provided in normal operation with an open switch position. The closing element is preferably held in an open condition by a spring, as long as the spring force is greater than the force brought about by the resistance of the flow in the valve on the closing element or on the surface of the plate of the plate valve. The valve remains open and flow can operate in both directions. If the existing flow rate exceeds the predetermined value defined by the maximum allowable pressure gradient, the spring force is overcome by the increase in the flow rate resistance and the closing element is suddenly slammed against its valve seat so that the flow through the valve is interrupted. The valve opens automatically as soon as a pressure balance is achieved and the pressure force ahead of the valve, composed of the spring force and the pressure force behind the valve, is less than the pressure force.

In a preferred embodiment of the invention, the valve arrangement contains a throttle or an orifice arranged parallel to the pipe break safety valve that permits a reduced flow rate when the pipe break safety valve is closed. This provides the assurance that a certain proportion of the flow rate continues to be conducted so that the pressure ahead of the valve arrangement cannot continue to increase. The throttle or orifice may be arranged in a bypass line parallel to the pipe break safety valve or it may be configured, for example, as a bore directly at the pipe break safety valve, particularly directly at the plate valve. At high flow rates, this provides the assurance that a major portion of the flow rate is intercepted by the closing of the pipe break safety valve and only a small portion of the hydraulic fluid reaches the throttle and that altogether a controlled pressure reduction is attained upon the switching into the floating position.

In a further embodiment of the invention the control valve connects a second chamber of the hydraulic cylinder over a second supply line selectively with the hydraulic pressure source or the reservoir. Thereby both chambers of a double-acting hydraulic cylinder can be supplied with pressure, which permits an accelerated emptying of the chambers, and thereby the extending and retracting of the piston of a hydraulic cylinder in shorter intervals is made possible. Preferably a second on-off valve is provided which controls the flow in a second hydraulic line extending between the second chamber and the reservoir and which opens parallel to the first on-off valve on the basis of a switch signal whereby a floating position can be provided in which the first chamber and the second chamber are connected to each other directly or indirectly over the reservoir. In this way the hydraulic cylinder can be brought into a floating position from every operating position or after an accidental switching into a floating position brought again immediately into an operating position without any significant pressure losses.

In a further embodiment of the invention, the first and/or the second supply line contains a load-holding valve arrangement. Load-holding valve arrangements are state of the art devices that are inserted into the supply lines of most modern valve arrangements as a safety feature, in order to prevent an unintended pressure drop in the consumer or the hydraulic cylinder. When leakages occur, whether at the control valve, at the supply line or at seals, etc. rapid pressure losses can occur in the hydraulic chambers of the hydraulic cylinder, particularly under load, which again represents a safety risk. In order to prevent pressure drops under load, such load-holding valve arrangements are positioned as close as possible to the hydraulic cylinder, so that as few components as possible are contained between the hydraulic cylinder and the load-holding valve arrangement that could permit leakages. Usually these load-holding valve arrangements are located directly at the hydraulic cylinder and are units of this group of components, so that no easily damaged components such as, for example, hoses must be supplied. Furthermore load-holding valve arrangements permit a sealing capability that prevents the least pressure losses under load over a longer time interval. An intentional pressure change is performed in that such load-holding valve arrangements are circumvented or opened by hydraulic circuit changes.

In combination with the first and second hydraulic lines, that connect in particular to great advantage, the chambers of the hydraulic cylinder in the floating position with the reservoir, on the one hand, an operating position with an integrated load-holding valve arrangement can be achieved, but, on the other hand, it can also be switched into a floating position with the aforementioned safety characteristics under a flow rate control.

Pipe break safety devices are applied, for example, as load-holding valve arrangements that contain various components such as, for example, lowering counter-torque valves, check valves that can be unlocked hydraulically, top load valves or the like.

In a particularly preferred embodiment of the invention, the load-holding valve arrangement contains a stop valve, for example, a stop valve that can be unlocked hydraulically, which is arranged in a locking position, and opens as a function of the pressure in the first and/or second supply line. Moreover, an additional check valve is provided parallel to the stop valve, where the additional check valve opens in the direction of the hydraulic cylinder. The load-holding valve arrangement is preferably arranged on the lifting side of the hydraulic cylinder, that is, on the pressure side that usually is safety relevant of the lifting cylinder that will be subject to high pressure on the basis of a load. The first chamber of the hydraulic cylinder can be filled by the pump over the corresponding supply line. Here the check valve effectively prevents an escape of the hydraulic fluid from this filled chamber. A first pressure line connects the second supply line with the stop valve. If the chamber is now to be emptied, the second chamber is filled over the second supply line, whereby a pressure is built up in the second supply line, which moves the stop valve from the locking position into a through-flow position. The hydraulic fluid can now flow from the first chamber into the hydraulic reservoir. As soon as the pressure in the second supply line drops off, for example, by switching to another operating position, the stop valve again resumes its locking position. Furthermore a second pressure line is provided as an overload security device on the side of the hydraulic cylinder in the first supply line which opens the stop valve at excessive pressure ratios on the lifting side of the hydraulic cylinder, independently of the switch position of the control valve.

In an especially preferred embodiment of the invention, the first and the second on-off valves are configured as seat valves that can be actuated electromagnetically. Thereby the on-off valves can be controlled by the generation of an electrical switching signal and switched into a floating position at any time. Here the application of on-off valves of other configurations is also conceivable, that can be switched, for example, pneumatically, hydraulically or even mechanically controlled.

Preferably the valve arrangements shown in the various embodiments are applied to a hydraulic cylinder for lifting and lowering a boom on a loader or construction vehicle, particularly on a telescopic loader. In that way, for example, the telescopic loader can be switched into the floating position in every operating position, even under load with a raised boom. A floating position without an operating flow rate control would lead to the boom moving downward under load more or less without control, which represents an increased safety risk. Simultaneously it is possible to utilize the floating position for operations on the surface of the ground. Furthermore, the possibility is offered with an integrated load-holding valve of supplying pressure to the lowering side of the hydraulic cylinder when the boom is raised by a corresponding control over the on-off valve, so that an accelerated downward movement of the boom occurs. Thereby a secure switching into the floating position is assured in all operating positions.

There is a particular advantage in the fact that through the configuration of the invention a floating position for a telescopic loader is assured while maintaining a load-holding valve arrangement (pipe break safety device) that is relevant to safety requirements. Furthermore, an interface can be realized, without costly configurations, so that the lifting devices already existing on a telescopic loader or the main valve need not be changed. Thereby the number of valve blocks can be kept to a minimum and the possibility of a retrofit or an improvement to an existing product is assured with the use of the same lifting cylinder with various differing options. Beyond that other variations are also conceivable that combine a floating position function, for example, with a hydraulic spring function, so that starting with a basic version with a load-holding valve arrangement a modular expansion with a floating position function and, beyond that, a modular expansion of the spring function is possible.

BRIEF DESCRIPTION OF THE DRAWINGS

The drawings show two embodiments of the invention on the basis of which the invention as well as further advantages and advantageous further developments and embodiments of the invention shall be explained and described in greater detail in the following.

DESCRIPTION OF THE PREFERRED EMBODIMENT

Figure 1:
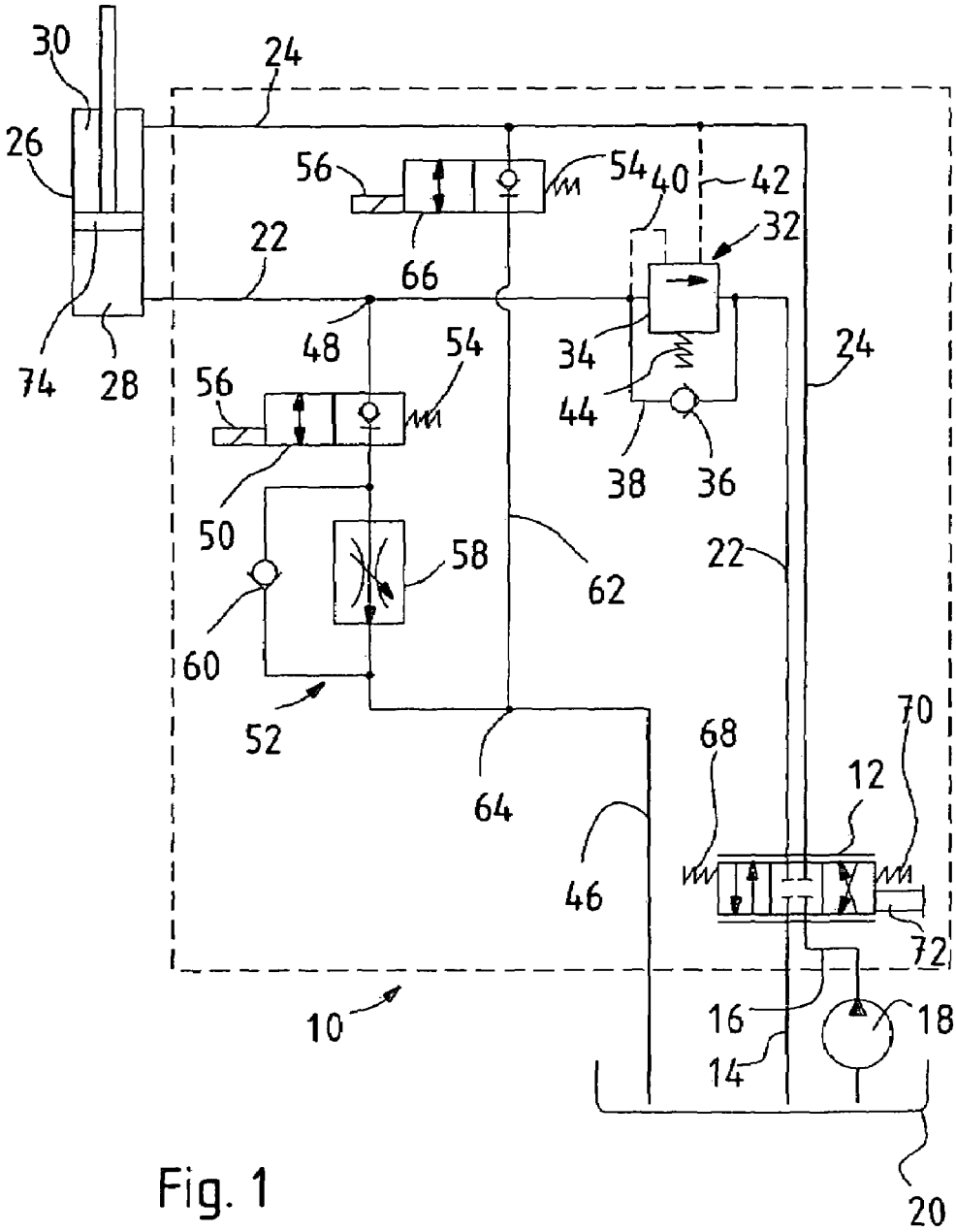
FIG. 1 is a circuit diagram of a first embodiment of a hydraulic control system or circuit constructed in accordance with the principles of the present invention.

The circuit diagram shown in FIG. 1 shows an embodiment of a hydraulic control system or circuit 10 for achieving a floating position in a hydraulic consumer. The control system 10 contains a control valve 12 that can be switched, for example, a slide valve that is connected by hydraulic lines 14 and 16, respectively to a pump 18 and a hydraulic reservoir 20 where the control valve 12 can be switched into three operating positions, namely, lifting, neutral and lowering. The switching of the control valve 12 is preferably performed manually, but can also be performed electrically, hydraulically or pneumatically.

The control valve 12 is connected over first and second supply lines 22 and 24, respectively, to a hydraulic cylinder 26, where the first supply line 22 leads to a first chamber 28 of the hydraulic cylinder 26 and the second supply line 24 leads to a second chamber 30 of the hydraulic cylinder 26. The first chamber 28 of the hydraulic cylinder 26 represents the piston end chamber or the lifting chamber, whereas the second chamber 30 of the hydraulic cylinder 26 represents the rod end chamber or the lowering chamber of the hydraulic cylinder.

A load-holding valve arrangement 32 is provided in the first supply line 22. The load-holding valve arrangement 32 contains a stop valve 34 that is controlled by pressure and by a spring, as well as a check valve 36 that opens towards the hydraulic cylinder side and that is arranged parallel to the stop valve 34 over a bypass line 38. A first pressure connection is established over a pilot pressure line 40 coupled between one end of the stop valve 34 and the section of the first supply line 22 on the side of the hydraulic cylinder. A second pressure connection is established over a pilot pressure line 42 coupled between the one end of the stop valve 34 and the second supply line 24. Furthermore a control spring 44 is engaged with a second end of the stop valve 34 and works in opposition to the pilot pressure so as to hold the stop valve 34 in the closing position when the pilot pressure is insufficient to overcome the biasing force of the spring 44.

A first hydraulic line 46 includes a first end 48 connected to the first supply line 22 at a location in communication with the first chamber 28 of the actuator 26 and with a port of the load-holding valve arrangement 32. A second end of the line 46 is coupled to the hydraulic reservoir 20.

In the first hydraulic line 46, a first on-off valve 50 as well as a valve arrangement 52 that is connected in a series circuit in the direction of the hydraulic reservoir 20 is arranged. The first on-off valve 50 represents a seat valve that can be switched electrically, that is held in a closing position by a control spring 54 and that can be brought into an open through-flow position by means of a solenoid 56. Thereby the on-off valve 50 seals in one or even in both directions, free of leakage. The valve arrangement 52 contains a flow control valve 58, that is arranged in a parallel circuit with a check valve 60, where the check valve 60 opens in the direction towards the hydraulic cylinder 26. Here it is also possible to arrange the valve arrangement 52 in the direction of the hydraulic reservoir 20 ahead of the on-off valve 50.

Furthermore, a second hydraulic line 62 is provided that connects the second supply line 24 with the first hydraulic line 46 at a connecting point 64 located in the first hydraulic line 46 between the hydraulic reservoir 20 and the valve arrangement 52.

Furthermore, the second hydraulic line 62 contains a second on-off valve 66, that is identical or equal to the first on-off valve 50 in configuration and function.

The individual operating conditions can now be controlled over the control valve 12 as well as over the on-off valves 50 and 66 as follows. As shown in FIG. 1, the control valve 12 is retained in the neutral position by the control springs 68 and 70 located at opposite ends of the valve 12. The on-off valves 50 and 66 are each in a closed position. The control valve 12 is brought out of the neutral position into the lifting or the lowering position over a control signal by means of an actuating arrangement 72. Here a manual, electrical, hydraulic or pneumatic actuating arrangement 72 may be used.

In the lifting position, the connection of the first supply line 22 with the pump 18 and the connection of the second supply line 24 with the hydraulic reservoir 20 is established. The pump 18, connected with the hydraulic reservoir 20, fills the first chamber 28 of the hydraulic cylinder 26 over the first supply line 22 and over the check valve 36 of the load-holding valve arrangement 32 (the stop valve 34 of the load-holding valve arrangement 32 is in the closed position). As a result, the piston 74 moves in the direction of the second chamber 30 and forces the oil contained there through the second supply line 24 into the hydraulic reservoir 20. If now the control valve 12 is again switched into the neutral position, then the control valve 12 blocks the connection to the pump 18 and to the hydraulic reservoir 20, so that the pressure in the two chambers 28 and 30 of the hydraulic cylinder 26 is maintained and the movement of the piston 74 is stopped. The piston 74 remains stopped.

In the lowering position, the connection of the first supply line 22 with the hydraulic reservoir 20 and the connection of the second supply line 24 with the pump 18 is established. The pump 18 conveys oil into the second chamber 30 of the hydraulic cylinder 26, where the pressure that is building up in the second supply line 24 opens the stop valve 34 over the pilot pressure line 42 of the load-holding valve arrangement 32. Simultaneously the piston 74 is moved in the direction of the first chamber 28, so that the oil flowing out of the first chamber 28 reaches the hydraulic reservoir 20 over the first supply line 22 and over the open stop valve 34.

Thereby the load-holding valve arrangement 32 guarantees that the hydraulic cylinder 26 maintains its position in the neutral position, or that no oil can escape in the lifting and neutral positions from the first chamber 28 that is loaded with pressure and that in the lowering position the oil can drain away out of the first chamber 28 over the open stop valve 34. In order to guarantee this, the load-holding valve arrangement 32 should or must sensibly be arranged as shown on the lifting side of the hydraulic cylinder 26, where the lifting side is the side of the hydraulic cylinder 26 in which a pressure is built up for the lifting of a load. In the embodiments described here, the lifting side is the first chamber 28 of the hydraulic cylinder 26, whereby inverting the hydraulic cylinder 26 the second chamber 30 could also be used as the lifting side. The pilot pressure line 40 represents an overload safety device, so that at excessively high operating pressures in the first chamber 28 of the hydraulic cylinder 26, that could be caused by excessively high loads carried, a limit pressure is reached in the pilot pressure line 40, that opens the stop valve 34 in order to bleed off the pressure.

In every desired operating position, the control circuit 10 can be switched into a floating position over the on-off valves 50 and 66. For that purpose, the on-off valves 50 and 66 are controlled in parallel by means of a switching signal so that the solenoids 56 oppose the spring force of the springs 54 and the on-off valves 50 and 66 are each essentially simultaneously brought out of the closing position into the through-flow position. As a result, the first chamber 28 and the second chamber 30 are connected, on the one hand, with each other, and, on the other hand, with the hydraulic reservoir 20, so that an exchange of hydraulic fluid or of oil can take place and the piston 74 can be moved freely in the floating position. If a switching under load takes place out of an operating position, then the oil flows under increased pressure out of the pressure-loaded first chamber 28, which leads to an accelerated movement of the piston. In order to limit this piston movement in its velocity, the flow control valve 58 comes into play which limits the flow rate or controls or regulates the through-flow of the oil. If the flow rate exceeds an allowable value, the through-flow cross section of the flow control valve 58 narrows so that the flow rate does not increase any further. Thereby uncontrolled movements of the piston 74 of the hydraulic cylinder are effectively prevented. In an opposite pressure effect in the direction of the first chamber 28, the check valve 60 makes it possible to circumvent the flow control valve 58 and thereby an uncontrolled flow through in the direction of the first chamber 28. Switching out of the floating position into an operating position is possible at any time by switching the on-off valves 50, 66 into a closed position.

Figure 2:
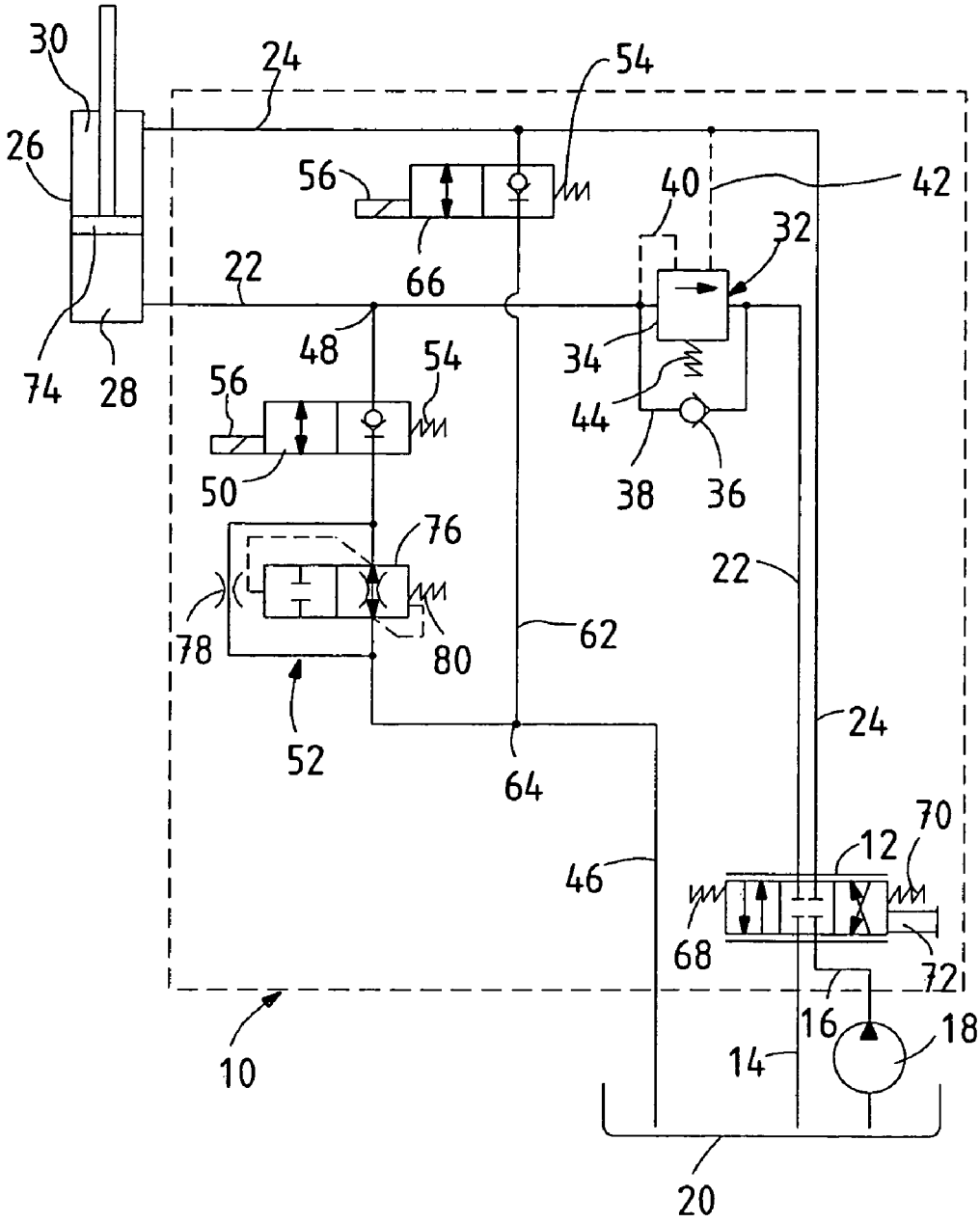
FIG. 2 is a circuit diagram of a second embodiment of a hydraulic control system or circuit constructed in accordance with the principles of the present invention.

A second embodiment is described on the basis of FIG. 2. Here identical or like components are identified by the same part number call-outs as in FIG. 1. According to FIG. 2, the valve arrangement 52 is modified by providing, in place of the flow control valve 58 and the check valve 60, a pipe break safety valve 76 in combination with a throttle 78 arranged in a parallel circuit. In place of the throttle 78, an orifice with the same effect could also be used. If the on-off valves 50 and 66 have been switched into the floating position, the pipe break safety valve 76 also brings about a reduction or limitation of the flow rate as a function of the flow. If the flow rate in the floating position in the first hydraulic line 46 reaches a limit value that can be provided as an input at the pipe break safety valve 76 on the basis of an excessive pressure in the first chamber 28, then a force resulting from the pressure difference building up opposes the spring force of a closing spring 80 acting at the pipe break safety valve 76 and closes the pipe break safety valve 76. Simultaneously, the oil flowing out of the first chamber 28 is diverted so that a sharply reduced, more controllable flow rate flows, and only very low velocities of movement of the piston 74 are permitted. Here it is also possible to arrange the valve arrangement 52 in the direction of the hydraulic reservoir 20 ahead of the on-off valve 50.

Figure 3:
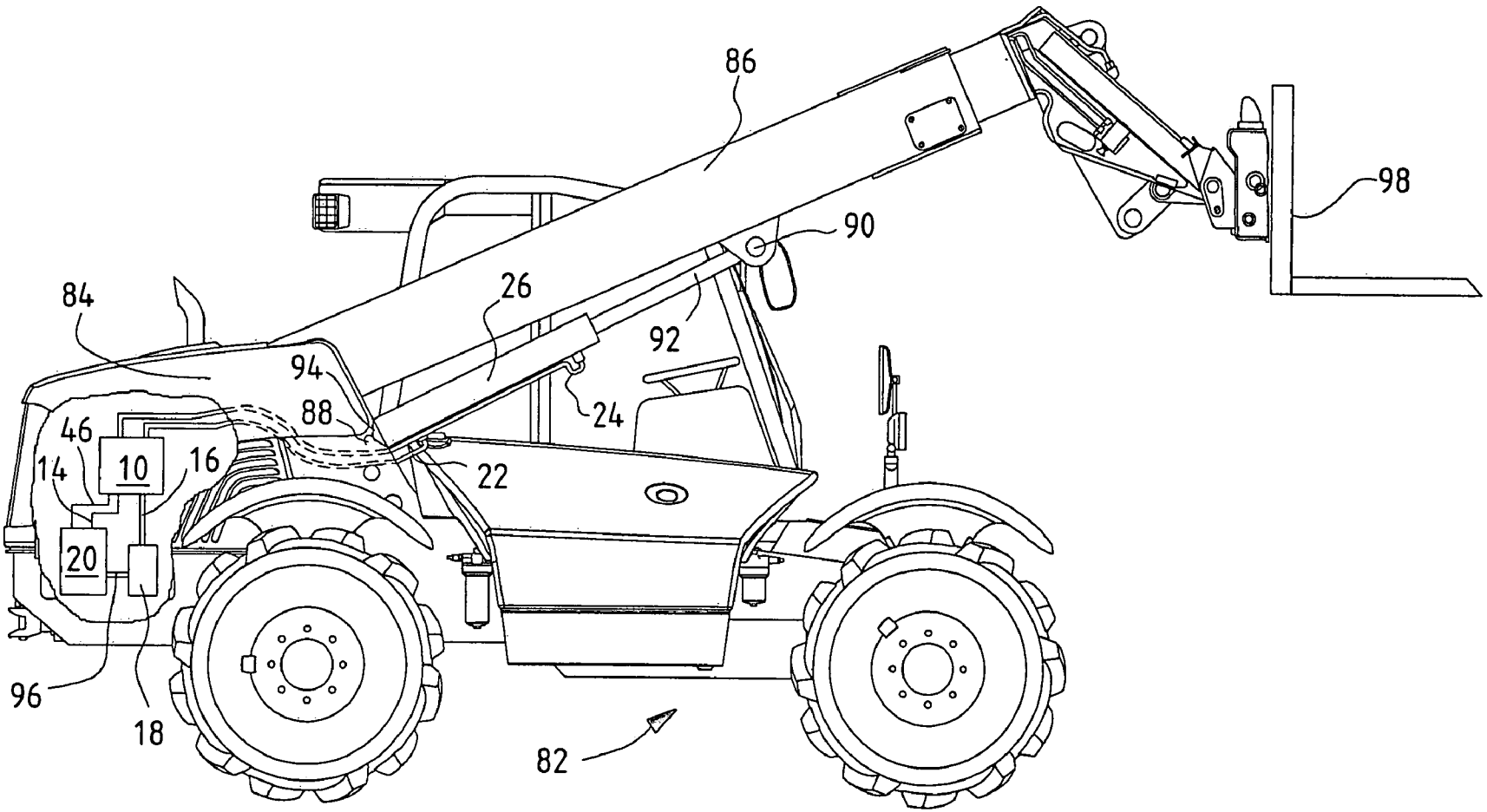
FIG. 3 is a schematic, right side view of a telescopic loader of the type with which a control circuit or system of the present invention is particularly adapted for use.

An application for the embodiments shown in FIGS. 1 and 2 is clarified in FIG. 3. FIG. 3 shows a mobile telescopic loader 82 with a boom 86 connected in joints, free to pivot, to a housing 84 or frame of the telescopic loader 82, that can be extended telescopically. The hydraulic cylinder 26 is arranged between the boom 86 and the housing 84 for lifting and lowering the boom 86. Here the hydraulic cylinder 26 is connected in joints, free to pivot, to first and second bearing points 88 and 90, respectively, where a piston rod 92 is connected in a joint to the second bearing point 90 at the boom 86 and a piston end side 94 is connected in a joint to the first bearing point 88 on the housing 84. Moreover, the hydraulic reservoir 20, the pump 18 as well as the hydraulic control circuit 10 are positioned in or at the housing 84 and connected to each other by the hydraulic lines 14, 16, 46 and 96. Furthermore, the portions of the supply lines 22 and 24 extending beyond the control circuit 10 to the hydraulic cylinder 26 can be seen in FIG. 3. Control or switching signals are generated over a control arrangement, not shown, with which the control valve 12 as well as the on-off valves 50, 66 (see FIGS. 1 and 2) are controlled or switched. Corresponding to the operating positions described previously, the hydraulic cylinder 26 can be actuated in such a way that the boom 86 can be raised, retained or lowered. Moreover, it is possible to switch into the floating position, so that the piston can be moved freely and the boom 86 can move in the floating condition. The floating position provides assurance that a tool 98 fastened to the boom 86 and lowered to the ground can be moved in a floating position following the contour of the ground across the surface of the ground. The contact pressure of the tool 98 against the ground is determined here essentially by the weight of the boom 86 and the tool 98. A safety function is provided here by the fact that a lowering of the boom 86 under load can be performed under flow rate control, so that no undesired, sudden changes in the movement can occur. If, for example, the boom 86 is in the raised position under load and then the system is switched into the floating position, then the flow control valve 58 or the pipe break safety valve 76 in connection with the throttle 78 provides the assurance that the boom 86 is lowered with a predetermined, controllable velocity. With these safety features provided by the control system 10 in the floating position, the system can be switched into the floating position from any operating position without bringing about any uncontrolled changes in the movement of the boom 86. Furthermore, hereby the control circuit 10 is provided with an integrated floating position in connection with a load-holding valve arrangement 32, with which a pressure-loaded lowering of the boom 86 by switching the control valve 12 in the lowering position with closed on-off valves 50 and 66 is possible.

Although the invention has been described in terms of only two embodiments, anyone skilled in the art will perceive many varied alternatives, modifications-and variations in light of the above description as well as the drawing all of which fall under the present invention. In that way, for example, the valve arrangement can also be applied to other vehicles, for example, to dredges or cranes, that are provided with components which can be actuated hydraulically that must be raised or lowered and in which a floating position appears useful.

Having described the preferred embodiment, it will become apparent that various modifications can be made without departing from the scope of the invention as defined in the accompanying claims.

The invention claimed is:

1. A hydraulic control circuit for a hydraulic cylinder having first and second chambers separated by a piston fixed to a piston rod, comprising: a hydraulic reservoir, a hydraulic pressure source; a control valve which selectively connects at least said first chamber of the hydraulic cylinder over a first supply line with said hydraulic pressure source or said hydraulic reservoir; a first hydraulic line extending between said first chamber and said reservoir; a first on-off valve that controls the flow through said first hydraulic line between said first chamber and said reservoir; said first on-off valve normally being in a position blocking flow through said first hydraulic line toward said reservoir and being responsive to a control signal for establishing a fluid path between said first chamber and said reservoir so as to establish a floating position; a valve arrangement contained and arranged in said first hydraulic line for controlling flow rate between said first chamber and said reservoir said valve arrangement including adjusting means for changing the through-flow opening and being coupled for receiving respective pressure signals from said first chamber and from said hydraulic reservoir and for receiving a spring force, said adjusting means operating to respectively reduce and increase a flow cross section across said valve arrangement in response to increasing and reducing pressure gradients; a second supply line coupled between said second chamber of said hydraulic cylinder and said control valve; said control valve being operable for selectively connecting said second chamber of said hydraulic cylinder with said hydraulic pressure source or with said hydraulic reservoir; a second hydraulic line connected between said second chamber of said hydraulic actuator and said reservoir; a second on-off valve located in said second hydraulic line and operable, on the basis of said control signal, to move to an open position wherein it establishes fluid communication between said second chamber and said reservoir, whereby a floating position can be provided, in which the said first and second chambers are connected directly or indirectly with each other over said hydraulic reservoir; a load-holding valve arrangement is coupled in one of said first and second supply lines for normally preventing flow from said one of said first and second supply lines to said reservoir by way of said control valve said load-holding valve arrangement having a stop valve; a spring biasing said stop valve to a closed position preventing flow to said control valve; a pilot pressure line coupled between at least one of said first and second chambers and said stop valve in opposition to said spring, whereby said stop valve opens as a function of the pressure in said at least one of said first and second chambers; and said load-holding valve further including a check valve arranged parallel to said stop valve, where the check valve opens in the direction of said hydraulic cylinder.

2. The hydraulic control circuit, as defined in claim 1, wherein said adjusting means further acts to reduce or interrupt a flow rate between said first chamber and said reservoir when a predetermined pressure gradient is exceeded.

3. The hydraulic control circuit, as defined in claim 1, wherein said adjusting means further includes one of a throttle or orifice arranged parallel to said pipe break safety valve for permitting a reduced flow rate when said pipe break safety valve is closed.

4. The hydraulic control circuit, as defined in claim 1, wherein said first and second on-off valves are seat valves which can be switched electromagnetically.

* * * * *